United States Patent [19]

Howell

[11] Patent Number: 4,645,889

[45] Date of Patent: Feb. 24, 1987

[54] VARISTOR QUENCHED ARC CHUTE FOR CURRENT LIMITING CIRCUIT INTERRUPTERS

[75] Inventor: Edward K. Howell, Simsbury, Conn.

[73] Assignee: General Electric Company, New York, N.Y.

[21] Appl. No.: 839,397

[22] Filed: Mar. 14, 1986

[51] Int. Cl.[4] ..... H01H 33/16

[52] U.S. Cl. ..... 200/144 AP; 200/144 C; 200/144 R

[58] Field of Search ..... 200/144 AP, 144 C, 144 R

[56] References Cited

U.S. PATENT DOCUMENTS

| | | | |
|---|---|---|---|
| 2,279,040 | 4/1942 | Grosse | 200/144 C |
| 2,753,423 | 7/1956 | Hairy | 200/144 |
| 3,495,056 | 2/1970 | Jensen | 200/144 AP |
| 3,543,047 | 11/1970 | Renfrew | 307/136 |
| 4,375,021 | 2/1983 | Pardini et al. | 200/147 |

*Primary Examiner*—Robert S. Macon

*Attorney, Agent, or Firm*—Richard A. Menelly; Walter C. Bernkopf; Fred Jacob

[57] ABSTRACT

A varistor quenched arc chute for current limiting circuit interrupters utilizes the combination of a plurality of stacked metal plates for attracting the arc that forms upon separation of the current limiting contacts with interspersed varistor elements for dissipating the system stored energy. The number of metal plates and the clamping voltage of the varistors is adjusted for optimum arc de-ionization. After arc extinction, the metal plates serve as cooling fins for the varistors.

5 Claims, 3 Drawing Figures

VARISTOR QUENCHED ARC CHUTE FOR CURRENT LIMITING CIRCUIT INTERRUPTERS

BACKGROUND OF THE INVENTION

The concept of current limiting, wherein the circuit is interrupted in the early stages of the current waveform, has resulted in corresponding reduction in the size of the components used to carry circuit current within the circuit interruption device. The rapid separation of the contacts within the device to achieve such current limiting, however, interrupts the circuit at the later stages of the voltage waveform, thereby requiring sophisticated arc-extinguishing apparatus. U.S. Pat. No. 4,375,021, entitled "Rapid Arc Extinguishing Assembly In Circuit Breaker Devices Such As Electric Circuit Breakers", describes the use of a high speed magnetically driven contact assembly to limit circuit current during the interruption process. The complex arc chute assembly described within this patent for cooling and extinguishing the arc that occurs during such rapid interruption adds to the economics of the breaker design.

The use of a voltage-dependent element such as a varistor electrically connected in parallel with a pair of separable contacts to absorb the system energy and to reduce arcing is described, for example, within U.S. Pat. No. 3,543,047, entitled "Contact Arc Suppressor Using Varistor Energy Absorbing Device". This patent concerns circuit interruption devices involved in relatively low energy electronic circuits. An early attempt to employ voltage dependent elements for arc suppression within molded case circuit breaker devices, such as used within residential and industrial power distribution systems, is described within U.S. Pat. No. 2,753,423, entitled "Arc Suppressors For Electric Switch Gear", discloses an arc chute made of a semi-conducting material that decreases in resistance upon reaching a predetermined voltage.

It has since been determined that the size of the arc chute required for cooling and extinguishing arcs that are created by high speed current limiting circuit interrupts can be effectively reduced by means of a combination metal plate-varistor arc chute wherein the metal plates serve to attract the arc to the varistors which, when conductive, quench the arc and, in time, become heated in the process. The metal plates then serve to effectively cool the varistors once the arc has been extinguished.

SUMMARY OF THE INVENTION

A combined metal plate-varistor arc chute wherein a plurality of varistor disks are interspersed between the metal plates of an arc chute assembly. The metal plates guide and direct the arc to the varistors which become conductive and dissipate the system energy, becoming heated in the process. When the arc is completely extinguished, the metal plates then serve to cool the varistors.

DESCRIPTION OF THE PREFERRED EMBODIMENT

Figure 1:
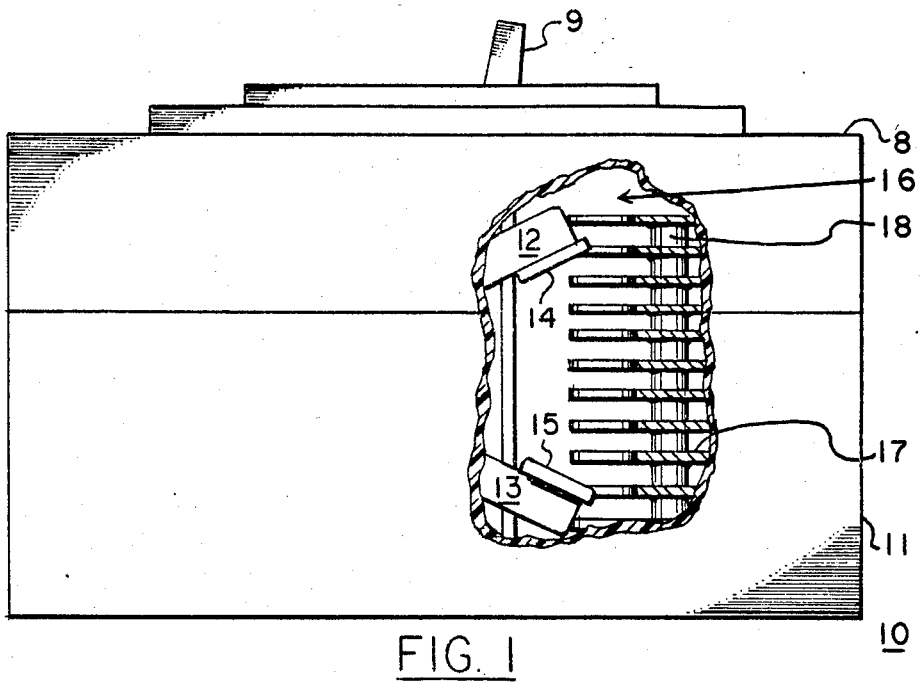
FIG. 1 is a side view of a current limiting circuit interrupter with a portion of the cover removed for revealing the combination metal plate-varistor arc chute according to the invention.

A current limiting molded case circuit breaker 10 such as described, for example, in U.S. Pat. No. 4,485,283 entitled "Current Limiter Unit" is shown in FIG. 1. The circuit breaker consists of a case 11 and a cover 8 through which an operating handle 9 protrudes for manual separation of a pair of movable contact arms 12, 13, each supporting a contact 14, 15 at their ends. The contact arms become electromagnetically repulsed, as described in the aforementioned patent, by the passage of a predetermined excess current through the movable contact arms, causing the contacts to separate and generating an arc therebetween. An arc chute 16, similar in some respects to that described in the aforementioned U.S. Patent, is employed to quench and cool the arc. The arc chute of the instant invention differs from that of the referenced patent by the inclusion of a plurality of varistor elements 18 between the spaced metal arc plates 17. The varistor elements are formed from zinc oxide or silicon carbide disks wherein the configuration and composition is adjusted to provide a desired clamping voltage. For the varistors depicted in FIG. 1, a 30 volt clamping voltage allows the varistors to become conductive when the arclets that occur between the metal plates equal or exceed 30 volts. Once the varistors become conductive, the arc current immediately transfers to the varistors since the arc resistance in the air spaces between the plates 17 is substantially higher than the resistance through the conducting varistors 18. Energy then becomes dissipated as $I^2R$ heating within the varistors, causing the varistors to rapidly increase in temperature. The current limiting circuit breaker 10 contains an operating mechanism which, although not shown, is similar to the over center operating spring commonly used in molded case industrial rated circuit breakers. After the movable contact arms 12, 13 have become separated, the operating mechanism responds and holds the contact arms in the open position. The voltage across the arc chute 16 decreases below the clamping voltage, such that the varistors 18 can no longer sustain conduction, causing the current through the varistors to rapidly approach zero. The plates 17 then serve to cool the varistors by rapidly transferring the heat away from the varistors to the surrounding air.

Figure 2:
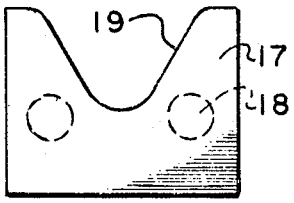
FIG. 2 is a top view of the combination metal plate-varistor arc chute depicted in FIG. 1.
Figure 3:
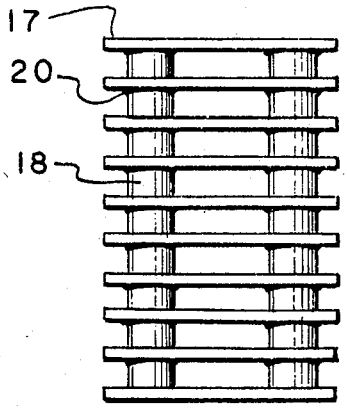
FIG. 3 is a side view of the combination metal plate-varistor arc chute depicted in FIGS. 1 and 2.

The arc plates 17, one of which is shown in FIG. 2, each have a curved end configuration 19 facing the contacts 14, 15 to receive the arc and to direct the current to the varistors 18. The varistors can be individually silver-soldered to the metal plates, as indicated at 20 in FIG. 3, or, the metal plates and varistors can be clampingly fastened together by the molded case.

The use of varistors in combination with metal plates to quench the arc that occurs upon contact separation substantially reduces the size and the number of the metal plates required, thereby resulting in a compact arc chute.

Having thus described my invention, what I claim as new and desire to secure by Letters Patent is:

1. A composite arc chute assembly for current limiting circuit interruption devices comprising:

a plurality of metal plates arranged in a stack for receiving an electric arc and having a predetermined spacing between each of said metal plates within the stack for receiving a corresponding plurality of arclets formed therein; and a plurality of varistor elements intermediate said metal plates and in electrical contact with said metal plates for receiving arc voltage generated across said plates from said electric arc and transferring arc current from said arclets to said varistors for dissipating energy, cooling and extinguishing said arc.

2. The composite arc chute assembly for current limiting circuit interruption devices of claim 1 wherein said varistors are fixedly attached to said metal plates.

3. The composite arc chute assembly for current limiting circuit interruption devices of claim 1 wherein said varistors comprise a clamping voltage of at least 18 volts.

4. The composite arc chute assembly for current limiting circuit interruption devices of claim 1 wherein said varistors are selected from the group of materials consisting of zinc oxide and silicon carbide.

5. The composite arc chute assembly for current limiting circuit interruption devices of claim 1 wherein said varistors and metal plates are clamped together.

* * * * *